US007425104B2

(12) United States Patent
Buteliauskas

(10) Patent No.: US 7,425,104 B2
(45) Date of Patent: Sep. 16, 2008

(54) ROAD JUNCTION

(76) Inventor: Stanislovas Buteliauskas, Plytines str.32, LT-10105 Vilnius (LT)

( * ) Notice: Subject to any disclaimer, the term of this patent is extended or adjusted under 35 U.S.C. 154(b) by 0 days.

(21) Appl. No.: 11/630,701

(22) PCT Filed: Oct. 8, 2004

(86) PCT No.: PCT/LT2004/000005

§ 371 (c)(1),
(2), (4) Date: Dec. 20, 2006

(87) PCT Pub. No.: WO2006/004384

PCT Pub. Date: Jan. 12, 2006

(65) Prior Publication Data

US 2007/0258759 A1 Nov. 8, 2007

(30) Foreign Application Priority Data

Jul. 2, 2004 (LT) ..... 2004 061

(51) Int. Cl.
*E01C 1/00* (2006.01)

(52) U.S. Cl. ..... 404/1

(58) Field of Classification Search ..... 404/1
See application file for complete search history.

(56) References Cited

U.S. PATENT DOCUMENTS

| | | | | |
|---|---|---|---|---|
| 1,689,161 | A * | 10/1928 | Skultin | 404/1 |
| 2,941,454 | A * | 6/1960 | Cedeno | 404/1 |
| 3,945,745 | A * | 3/1976 | Chang | 404/1 |
| 2002/0076276 | A1 * | 6/2002 | Troemel et al. | 404/1 |

* cited by examiner

*Primary Examiner*—Raymond W Addie
(74) *Attorney, Agent, or Firm*—Abelman, Frayne & Schwab

(57) ABSTRACT

The invention relates to the area of road construction and may be used in the design of new or reconstruction of existing road junction with heavy traffic. The known junctions of roads do not ensure sufficient safe traffic, are complex and confusing to drivers, and have limited permeability and applicability. In order to increase traffic safety, the permeability of a junction, make it understandable to drivers, reduce the construction coasts and expand its applicability to junctions of three-way roads, each road's roadway for driving through the junction makes a right of a wide radius before the viaduct and under it, and then makes a left turn of a wide radius up to the next viaduct and through it. In all junctions of roads, the center of the radius of the left turn of each of the junction's roadway is shifted forward.

12 Claims, 3 Drawing Sheets

ROAD JUNCTION

TECHNICAL AREA

The invention "Road Junction" is attributed to the area of road construction and can be used to design new or reconstruct existing heavy-traffic road junctions.

PRIOR ART

Self-determination roundabouts, where any number of roads cross and traffic moves in a circle are well known. They do not meet modem traffic safety and roundabout capacity requirements at heavy-traffic motorway crossroads because roadway intersections are on the same level.

Other road junctions where roadways do not intersect, but are built, in reference to each other, on different levels either along or under overpasses, are also known. A cursory look at traffic in these junctions seems to suggest that they as if meet technical requirements because traffic flows in them pass each other at different levels. However, upon closer scrutiny, these junctions are very complex and confusing for drives; traffic speed in some directions in them drops almost 2.8 times; therefore, traffic safety and junction capacity are insufficient. Moreover, they are very expensive. Drawings and descriptions of these crossroads and junctions are available in the book Miestotvarka, Vilnius: Technika, 2003, p. 228-234 and the journal Statyba ir architektūra, No 9, 2002, as well as in the USSR certification of invention No 1786221, E01C January 2004. Junctions and crossroads provided in the aforementioned sources have one more shortcoming. They can be applied to only four-direction road junctions with the exception of roundabouts.

The analogue of the invention is the "Improved Roundabout with Five Overpasses" represented on p. 229 of the book Miestotvarka. The analogue represents two intersecting roads. The roadway of one road is intended for moving straight along the overpass, that of the other—under the overpass. A road of circular traffic movement direction is built for turning to the right and to the left. This road is intended for driving to the left. Its roadway at the places where traffic directions intersect is built along overpasses or under them and thus helps avoid intersection of roadways. The roadway of the right curve of each road leads to the right well before the circular traffic movement overpass. The roadway intended for moving straight and to the left of one of the intersecting roads is built along the circular traffic movement overpass, the roadway of the other road—under the circular traffic movement road overpass. Right behind the circular traffic movement overpass, the roadway of each road for turning to the left is connected by abrupt right and left curves, with the roadway of the circular traffic movement road.

The main drawbacks of this crossroad are:

the curves of the roadway for driving to the left before entry into the circular traffic movement direction road are too abrupt and decrease road traffic capacity in this direction almost three times and considerably increase the probability of road accidents (the radius of the turn curves is 2.8 times smaller than the radius of the curve of the circular traffic movement direction road);

drivers are not accustomed to using the right lane of the road intended for driving to the objects situated on the left side of the road; therefore, they are forced to unexpectedly change traffic lanes at the crossroads. This increases tension and causes additional danger to traffic safety;

a great number of overpasses and their length considerably increase crossroad building costs;

a crossroad of this design cannot be applied for junctions of three, five or more road directions.

SUMMARY OF THE INVENTION

The purpose of the claimed invention is to considerably increase traffic safety and traffic capacity at the road junction, decrease its building costs, make the road junction easy to understand for drivers and expand junction application possibilities for road junctions of tree, five or more road directions.

The essence of the invention lies in the fact that in order to increase traffic safety and junction capacity as well as expand its application to junctions of three road directions, the roadway of each road intended for driving through the junction before the entry into junction must make a large-radius right curve with a possible slope before the overpass and under it; behind the overpass, it must make an ascending large-radius left curve leading to the overpass, along it and then turn to the right. This provision must be applied to junctions of any number of road directions, but is sufficient for a junction only three road directions.

In order to reduce the number of overpasses in a four road direction junction, the roadway intended for driving through the junction forks into two parts behind the overpass along which it runs; the right part of the roadway makes a large-radius right curve and leads to the right, whereas the left part makes a large-radius left curve, continues along the nearest overpass and turns to the right behind it.

In order to expand the application of the junction for five and more road direction junctions, under each overpass at least two roadways must be built so that between the right and the left roadway, running along the nearest overpass, at least one roadway could fit in.

In order to get maximum increase in the radii of the curves of the left traffic movement direction roadways and retain them stable throughout the junction, their centers are shifted forward along the movement direction, behind the geometrical center of the junction and to the left of it. A charge in the curve direction is possible at the tangent point of these curves or by inserting tangents.

The totality of technical solutions of the suggested invention allows making curve radii of all junction roadways stable and not smaller than the smallest curve radii of the intersecting roads. This makes it possible for drivers to move safely within the junction in any direction at a stable speed that is not lower than that in intersecting roads. A rational and easy to understand arrangement of traffic lanes, a combination of lanes and overpasses make it possible to move through the road junction in any desired direction without changing the lane in the junction itself and considerably increase traffic safety. Traffic movement directions along the lanes conform to the requirements of traffic rules: the right lane is for driving to the right, the outside left lane is for moving to the left and middles lanes are for driving straight.

Building costs of a junction considerably decrease, since the number and length of overpasses decreases—four instead five (in a four road direction junction which corresponds to the analogue). The number of overpasses is equal to the number of road directions of the junction. Each overpass is built not through the entire width of the geometrically intersected road but only through the width of one roadway; therefore, the length of overpasses decreases almost twice and building costs of the junction are also reduced.

The claimed invention is suitable for three, four and five road direction junctions and could easily be applied for junctions of still more road directions.

DESCRIPTION OF THE DRAWINGS

The drawing of the road junction, the arrangement of traffic lanes, roadways and overpasses within the junction and possibilities for its application are represented in FIG. 1, FIG. 2 and FIG. 3.

DETAILED DESCRIPTION OF THE INVENTION

Figure 1:
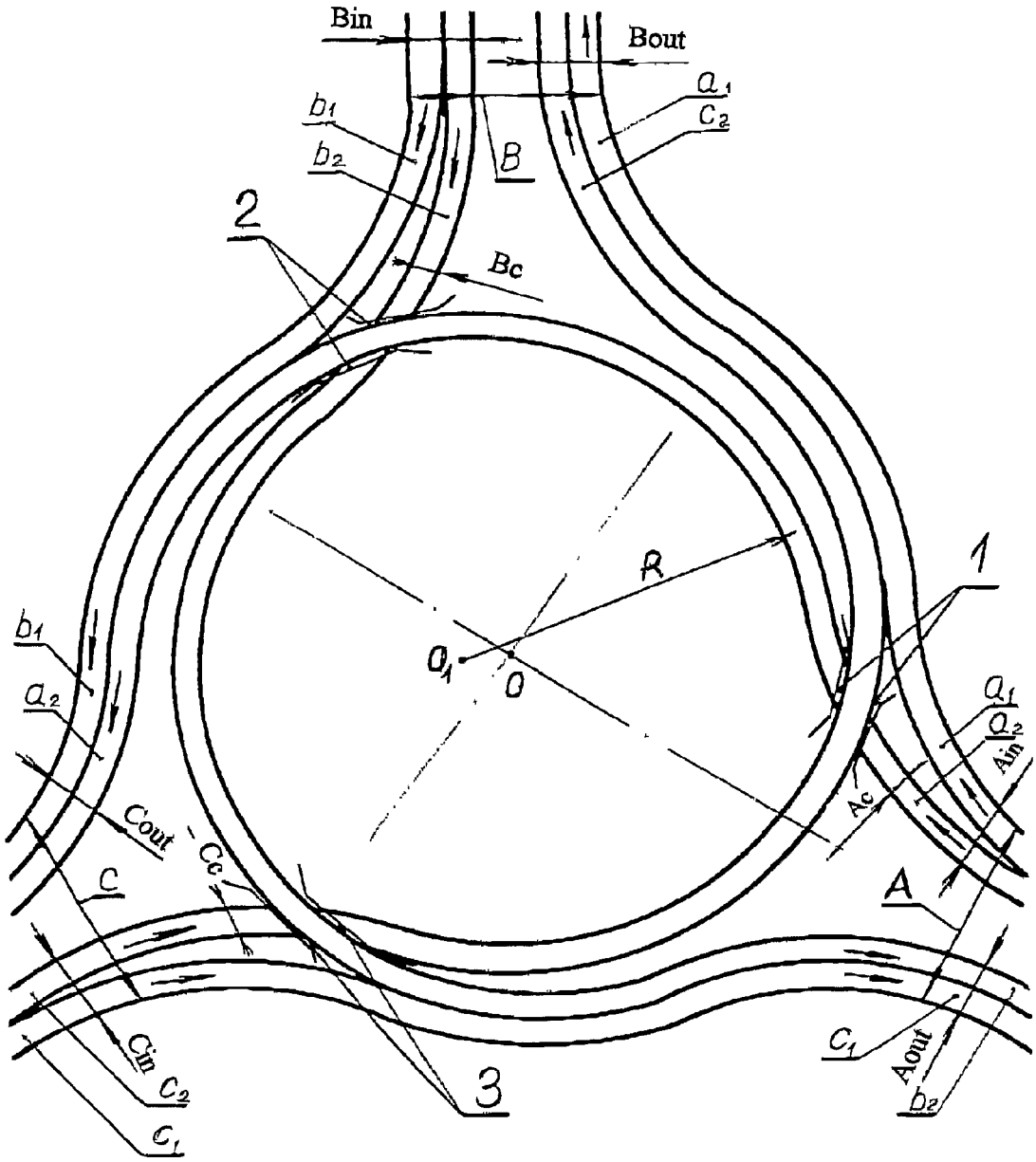
FIG. 1 represents a three road direction junction.

FIG. 1 represents a three-road direction junction, which consists of:

road A, roadway Aiv of this road with traffic lanes $a_1$ and $a_2$ for entry into the junction, roadway Avm for moving through the junction, roadway Aišv with lanes $c_1$ and $b_2$ for exiting the junction;

road B, roadway Biv of this road with lanes $b_1$ and $b_2$ for entry into the junction, roadway Bvm for moving through the junction, roadway Aišv with lanes $a_1$ and $c_2$ for exiting the junction;

road C, roadway Civ of this road with lanes $c_1$ and $c_2$ for entry into the junction, roadway Cvm for moving through the junction, roadway Cišv with lanes $b_1$ and $a_2$ for exiting the junction;

overpasses 1, 2 and 3.

The roadway of road A with traffic lane $a_1$ is separated from roadway Avm before the junction and is built first by making a large radius right curve then a large radius left curve and thus joins roadway Cvm of road C which runs next to it on the left. The joint roadway is built by making a large radius right curve, leads to road B and makes up its roadway Bišv with lanes $a_1$ and $c_2$. The other roadway Avm of road A is built first by making a large radius right curve sloping to overpass 1 and under it, then by ascending left curve it leads to overpass 2 and along it. The center of the left curve radius is shifted forward along the movement direction, behind the geometrical center of the junction and to the left of it. Behind the overpass this roadway joins the roadway of road B with lane $b_1$, which runs next to it on the right. The joint roadway by first making a left and then a right large radius curve leads to road C and makes up its roadway Cišv.

The roadways of roads B and C are built by analogy to road A.

Figure 2:
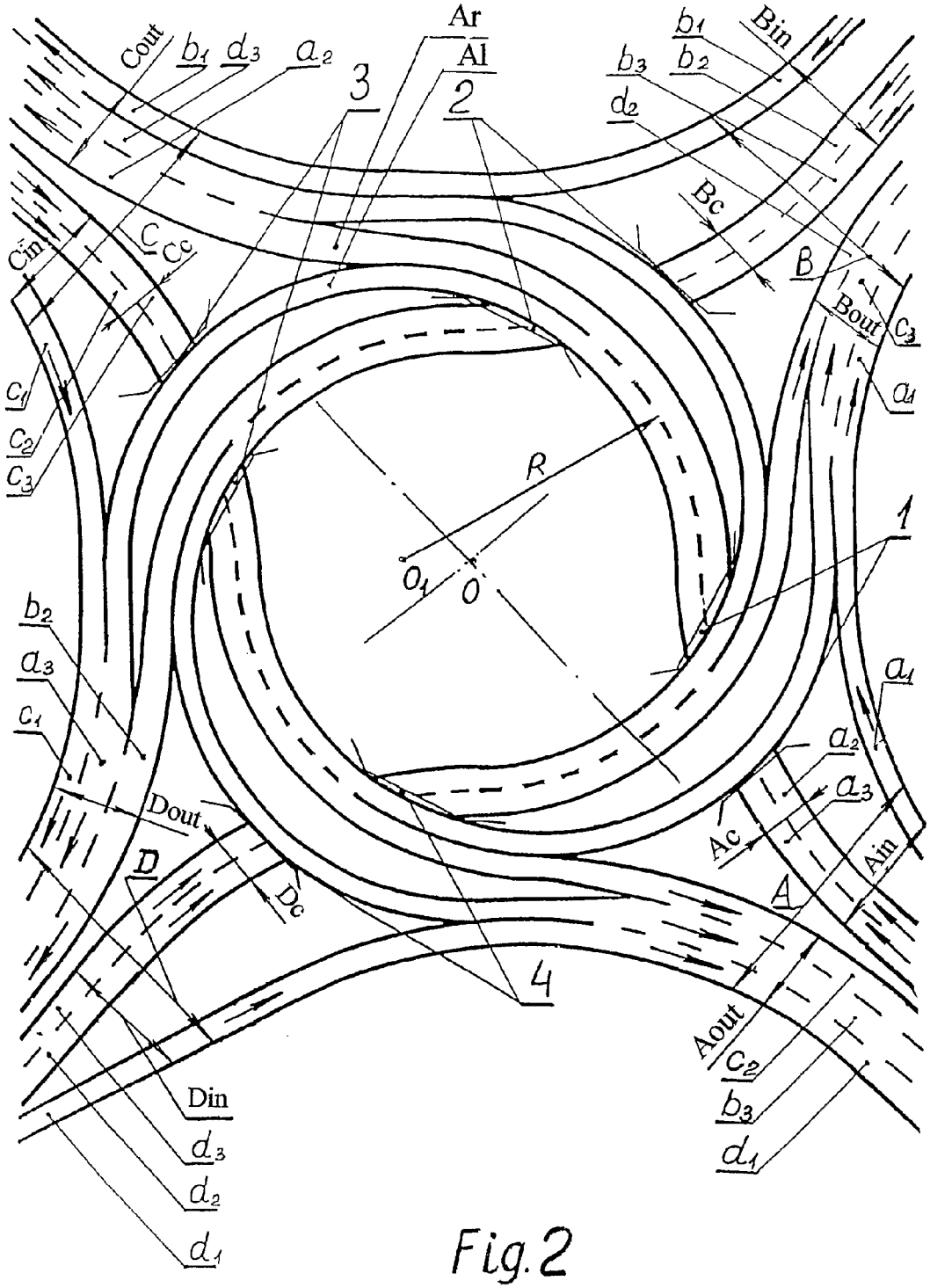
FIG. 2—that of four road direction.

FIG. 2 represents a four-road direction junction, which consists of:

road A, roadway Aiv of this road with traffic lanes $a_1$, $a_2$ and $a_3$ for entry into the junction, roadway Avm for moving through the junction, roadway Aišv with lanes $d_1$, $b_3$ and $c_2$ for exiting the junction;

road B, roadway Biv of this road with traffic lanes $b_1$, $b_2$ and $b_3$ for entry into the junction, roadway Bvm for moving through the junction, roadway Bišv with lanes $a_1$, $c_3$ and $d_2$ for exiting the junction;

road C, roadway Civ of this road with traffic lanes $c_1$, $c_2$ and $c_3$ for entry into the junction, roadway Cvm for moving through the junction, roadway Cišv with lanes $b_1$, $d_3$ and $a_2$ for exiting the junction;

road D, roadway Div of this road with traffic lanes $d_1$, $d_2$ and $d_3$ for entry into the junction, roadway Dvm for moving through the junction, roadway Dišv with lanes $c_1$, $a_3$ and $b_2$ for exiting the junction;

overpasses 1, 2, 3 and 4.

The roadway of road A with traffic lane $a_1$, is built like in a three road direction junction. Before overpass 2, roadway Avm, which is made up of traffic lanes $a_2$ and $a_3$ is built like in a three-road direction junction. Behind overpass 2 roadway Avm forks into two parts: the right part Ad and the left part Ak. The right roadway with lane $a_2$ then joins traffic lanes $d_3$ and $b_1$ of roads D and B that are next to it on the right and leads, by making a right curve, to road C becoming its roadway Cišv. The left roadway Ak continues by making a left curve to overpass 3 and along it. Behind the overpass, it is joined on both sides by roadways of roads B and C with traffic lanes $b_2$ and $c_1$. Then the joint roadway by making a right curve leads to road D and makes up its roadway Dišv.

The roadways of roads B, C and D within the junction are built by analogy to road A.

Figure 3:
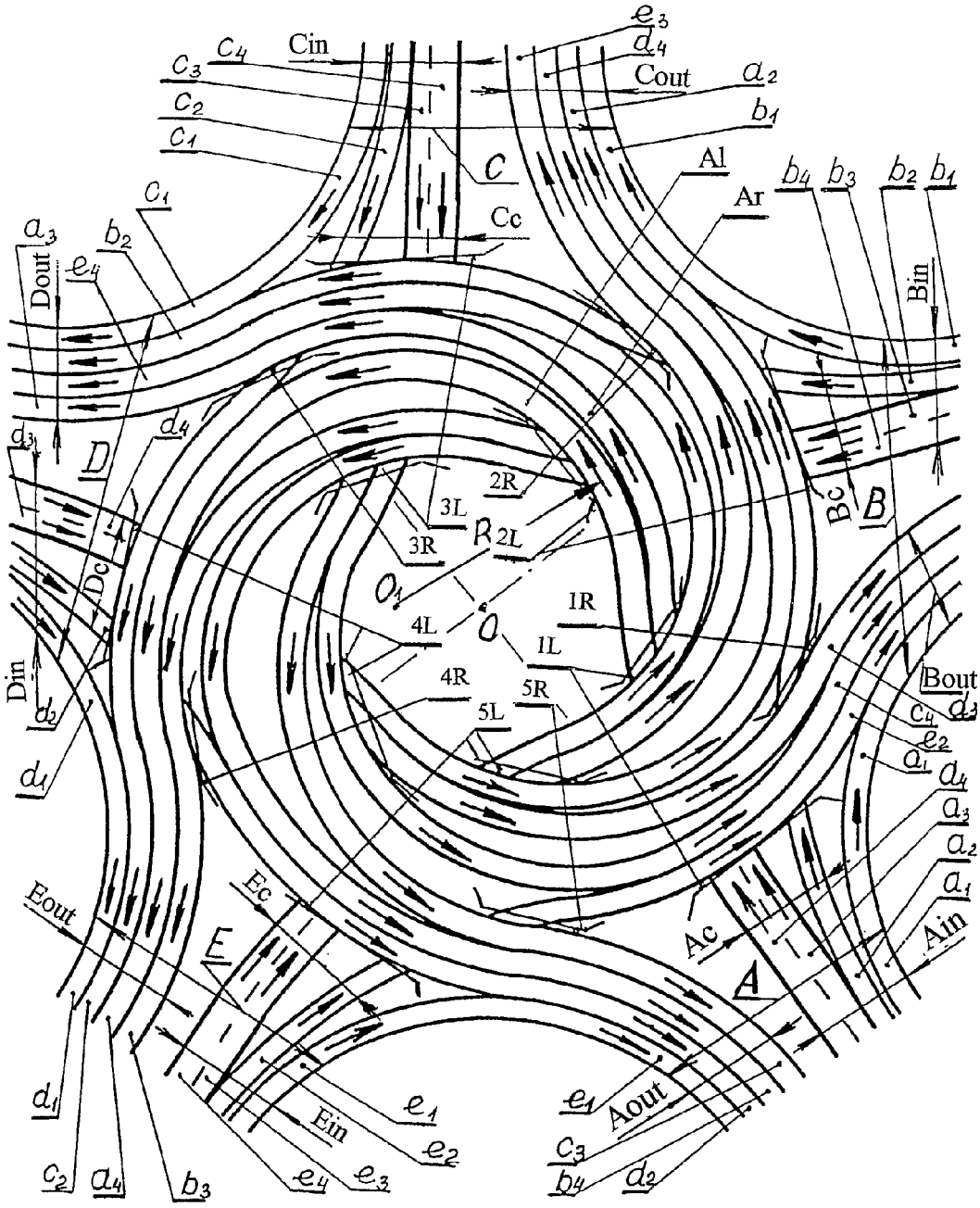
FIG. 3 a road junction of five road directions.

FIG. 3 represents a five road direction junction, which consists of:

road A, roadway Aiv of this road with traffic lanes $a_1$, $a_2$, $a_3$ and $a_4$ for entry into the junction, roadway Avm for moving through the junction, roadway Aišv with lanes $e_1$, $d_2$, $b_4$ and $c_3$ for exiting the junction;

road B, roadway Biv of this road with traffic lanes $b_1$, $b_2$, $b_3$ and $b_4$ for entry into the junction, roadway Bvm for moving through the junction, roadway Bišv with lanes $a_1$, $e_2$, $c_4$ and $d_3$ for exiting the junction;

road C, roadway Civ of this road with traffic lanes $c_1$, $c_2$, $c_3$ and $c_4$ for entry into the junction, roadway Cvm for moving through the junction, roadway Cišv with lanes $b_1$, $a_2$, $d_4$ and $e_3$ for exiting the junction;

road D, roadway Div of this road with traffic lanes $d_1$, $d_2$, $d_3$ and $d_4$ for entry into the junction, roadway Dvm for moving through the junction, roadway Dišv with lanes $c_1$, $b_2$, $e_4$ and $a_3$ for exiting the junction;

road E, roadway Eiv of this road with traffic lanes $e_1$, $e_2$, $e_3$ and $e_4$ for entry into the junction, roadway Evm for moving through the junction, roadway Eišv with lanes $d_1$, $c_2$, $a_4$ and $b_3$ for exiting the junction;

overpasses 1, 2, 3, 4 and 5.

Under each overpass of this junction there are two tunnel parts: 1K, 1D, 2K, 2D, 3K, 3D, 4K, 4D, 5K and 5D. A five-road direction junction is a hybrid of three and four road direction junctions. In it the roadway of road A with traffic lane $a_1$ and the roadway with traffic lane $a_2$ are built by analogy to those in a three-road direction junction. The roadway with traffic lanes $a_3$ and $a_4$ is built by analogy to the roadway with lanes $a_2$ and $a_3$ in a four road direction junction. Besides, on overpass 2, between the roadway with lane $a_2$ and the roadway with lanes $a_3$ and $a_4$, a three-lane roadway with lanes $e_4$, $e_3$ and $d_4$ is built. Roadways of roads B, C, D and E are built by analogy to road A.

Traffic movement in a three-road direction junction is very simple. The driver, who is moving along road A and wants to get to road B, must take the right traffic lane $a_1$. Upon entering the junction, the driver notices that vehicles from road C are moving next to him on the left lane $c_2$. The driver does not have to change lanes or yield to other traffic. When the driver moving through the junction wants to turn left (to get to road C), he takes the left traffic lane $a_2$, drives under overpass 1, then ascends and moves along overpass 2; behind this overpass, on right side of the roadway, traffic lane $b_1$ emerges and is used by vehicles coming from road B. In this case drives can also keep moving without changing lanes.

Traffic movement in four or five road direction junctions is absolutely analogous to the described one.

The invention claimed is:

1. A road junction for right-hand traffic comprising:

three or more intersecting roads, overpasses and tunnels, with entry roadways of two or more lanes entering the junction by curving to the right, with one or more of the rightmost lanes of the entry roadways separating from the other lanes of the respective entry roadways and, without traveling via either an overpass or tunnel, exiting to the next road on the right, and the remaining lane or lanes passing over or under intersecting roadways via one or more overpasses or tunnels, initially maintaining the curve to the right and then, after passing one or more of the said one or more overpasses or tunnels, curving to the left into a counterclockwise circular motion of fixed radius, and continuing in that counterclockwise circular motion until reaching the desired point at which to exit to an intersecting road, at which point the exiting lane or lanes curve to the right and exit the junction to the selected intersecting road.

2. The road junction of claim 1, characterized in that when applying to a road junction with more than four roads, each roadway used for driving through the junction to exit to any road but the first one on the right, is split into two before reaching the first tunnel or overpass, the lanes diverging to leave space in between them for at least one circular motion roadway coming from the other roads.

3. The road junction of claim 1, characterized in that the center of the radius of the curve of the circular motion roadway of each road is shifted forward from and to the left of the geometric center of the junction in the direction of driving and away from the given circular motion roadway.

4. The road junction of claim 3, whereby the said shift decreases the outer size of the junction by up to 15%.

5. The road junction of claim 2, characterized in that the center of the radius of the curve of the circular motion roadway of each road is shifted forward from and to the left of the geometric center of the junction in the direction of driving and away from the given circular motion roadway.

6. The road junction of claim 5, whereby the said shift decreases the outer size of the junction by up to 15%.

7. A road junction for left-hand traffic comprising:

three or more intersecting roads, overpasses and tunnels, with entry roadways of two or more lanes entering the junction by curving to the left, with one or more of the leftmost lanes of the entry roadways separating from the other lanes of the respective entry roadways and, without traveling via either an overpass or tunnel, exiting to the next road on the left, and the remaining lane or lanes passing over or under intersecting roadways via one or more overpasses or tunnels, initially maintaining the curve to the left and then, after passing one or more of the said one or more overpasses or tunnels, curving to the right into a clockwise circular motion of fixed radius, and continuing in that clockwise circular motion until reaching the desired point at which to exit to an intersecting road, at which point the exiting lane or lanes curve to the left and exit the junction to the selected intersecting road.

8. The road junction of claim 7, characterized in that when applying to a road junction with more than four roads, each roadway used for driving through the junction to exit to any road but the first one on the left, is split into two before reaching the first tunnel or overpass, the lanes diverging to leave space in between them for at least one circular motion roadway coming from the other roads.

9. The road junction of claim 7, characterized in that the center of the radius of the curve of the circular motion roadway of each road is shifted forward from and to the right of the geometric center of the junction in the direction of driving and away from the given circular motion roadway.

10. The road junction of claim 9, whereby the shift decreases the outer size of the junction by up to 15%.

11. The road junction of claim 8, characterized in that the center of the radius of the curve of the circular motion roadway of each road is shifted forward from and to the right of the geometric center of the junction in the direction of driving and away from the given circular motion roadway.

12. The road junction of claim 11, whereby the shift decreases the outer size of the junction by up to 15%.

* * * * *